United States Patent [19]

Magee et al.

[11] Patent Number: 4,483,040

[45] Date of Patent: Nov. 20, 1984

[54] IN-LINE MASK CLEANING SYSTEM

[75] Inventors: Robert A. Magee, Poughkeepsie; Lawrence P. Remsen, Stanfordville, both of N.Y.

[73] Assignee: International Business Machines Corporation, Armonk, N.Y.

[21] Appl. No.: 452,250

[22] Filed: Dec. 22, 1982

[51] Int. Cl.[3] ..... B08B 3/02; B08B 5/02

[52] U.S. Cl. ..... 15/302; 15/303; 15/310; 15/312 R

[58] Field of Search ..... 15/302, 312 R, 306 A, 15/306 B, 306 R, 308, 310

[56] References Cited

U.S. PATENT DOCUMENTS

| | | | |
|---|---|---|---|
| 1,644,384 | 10/1927 | Kendall | 15/302 X |
| 2,566,142 | 8/1951 | Powers | 15/302 X |
| 3,653,425 | 4/1972 | Elliot et al. | 15/302 X |
| 3,736,618 | 6/1973 | Ramsey | 15/302 X |
| 3,942,213 | 3/1976 | Hoener | 15/302 |
| 4,244,078 | 1/1981 | Hughes et al. | 15/302 |

*Primary Examiner*—Chris K. Moore

*Attorney, Agent, or Firm*—Sughrue, Mion, Zinn, Macpeak & Seas

[57] ABSTRACT

A system for cleaning material from a surface of an object, such as an MLC mask, having movable support member having extended along its length a line of liquid dispensing nozzles and a line of gas dispensing ports for respectively cleaning and drying the surface. The liquid dispensing nozzles and said gas dispensing ports are arranged to respectively provide a continuous line of liquid spray and a continuous line of gas at an angle with respect to the surface so as to form a wedge therewith in the direction of motion of the movable support member. The nozzles and ports are preferably arranged on both sides of the object to simultaneously clean both sides. The support member is moved vertically with respect to the surface by an air cylinder. The vertical movement of the respective lines of nozzles and ports so that said liquid dispensing nozzles act to provide said continuous line of liquid spray to remove said material from said surface when said line of spray is moved vertically across said surface and said gas dispensing ports subsequently act to provide said continuous line of gas to remove the liquid from the surface when the line of gas is moved vertically across the surface. The material and liquid are deposited below the surface for collection and removal.

13 Claims, 4 Drawing Figures

IN-LINE MASK CLEANING SYSTEM

BACKGROUND OF THE INVENTION

This invention relates to a system for cleaning material from the surface of an object. In particular, it relates to an apparatus for cleaning masks used for screening a pattern on a surface, such as a semiconductor substrate.

Typically, in the manufacture of semiconductor components, circuits are defined by the printing of conductive patterns on a ceramic substrate. The substrate, uncured, is a thin, flexible material having an array of through-holes. Each of these holes (vias) are filled with a conductive paste and a conductive circuit pattern is printed where desired on the surface. One prior art technique of screening the ceramic green sheet is described in U.S. Pat. No. 4,068,994.

One disadvantage of the technique defined in the '994 patent is that during the screening process a residual paste deposit adheres to the screening mask. This effectively prevents utilizing the mask for multiple screening passes without first totally cleaning the mask. In use, the mask is removed from the apparatus, manually transported to an off-line vapor degreaser, cleaned with a suitable solvent (perchloroethylene, hereinafter "perchlor") and, subsequently reinserted into the apparatus for a subsequent screen pass. As can be appreciated, this procedure is labor intensive and relatively inefficient. The productivity rate is less than 200 green sheets per day per screening machine.

An improved device utilizing in-line mask cleaning is disclosed in a commonly assigned patent application entitled "Automatic Multilayer Ceramic (MLC) Screening Machine", Ser. No. 194,724 filed Oct. 7, 1980, and now U.S. Pat. No. 4,362,486, issued Dec. 7, 1982. The system defined in this patent application utilizes a series of horizontally movable carriages traveling on common rails between loading and unloading stations. The carriages have coupled to them trays carrying stacked green sheets so that a topmost sheet may be selectively transferred at a loading station while the carriage having, itself a vertically displaceable green sheet support fixture, is at a screening station for the application of paste screening onto a green sheet. In accordance with the teachings of this patent application, reciprocating action also occurs, vis-a-vis the mask employed in the screen printing. Specifically, the masks are removed from the screening station and placed in a cleaning chamber for the removal of residual screening paste using perchlor. They are then air dried prior to return to the screening station. A second clean mask is automatically presented at the station during cleaning of a dirty mask, thereby eliminating throughput loss. The cleaning station employs a series of stationary spray nozzles and stationary spray horns to effectuate cleaning and drying. Spray retaining plates and internal manifolding is utilized to remove both the solvent and the residual mask paste.

A primary deficiency of this system is that rigid emission controls of the vapor solvent generated cannot be maintained while achieving the productivity advantage inherent in the remainder of the system. The ability to maintain strict control vapor emission standards, for example, less than 12.5 ppm of perchlor, is an important safety consideration. Green sheet handling systems are operated in an area normally controlled by human operators and accordingly, existing Federal emission controls must be satisfied.

Another disadvantage of this system is that it utilizes multiple chambers, one for the application of perchlor and a second for drying. The system therefore is not self-cleaning and the formation of solids which tend to build up on the inner surfaces of the apparatus is not minimized. Such solid buildup increases maintenance costs and tends to entrap perchlor thereby increasing the potential for harmful emissions. Hence, in this prior art system, the perchlor is applied in a first tank for cleaning and the screen is then moved to a second tank for air drying. Consequently, in the cleaning tank, the wall surfaces themself then to accumulate residual materials which include not only the cleaning solvent but also the excess paste material that has been removed from the screens. The present application is a direct improvement over the system of co-pending application 194,724.

Within the prior art generally relating to concepts of screen printing, various techniques of washing the screen unit have been utilized. In German Pat. No. 2,417,176, an automatic screen washing unit is disclosed for removing residual ink from the screen printing template. Washing occurs by contact with rotary brushes in the presence of a solvent. The system, however, cannot be applied to contact cleaning of multilayer ceramic moly masks given their inherent intricacy. Contact systems may destroy or subtly alter the screen pattern having diastrous consequences, vis-a-vis the pattern subsequently printed on the substrate. This patent also does not define systems of solvent vapor emission control.

Another technique of contact cleaning is described in U.S. Pat. No. 3,737,940 wherein the cylindrical surface of an offset printing mechanism is cleaned by the use of a sponge or bristle roller. Contact at the surface to be cleaned occurs in the presence of a sprayed solvent. Solvent leakage is prevented by defining a vacuum system. However, techniques of solvent emission abatement are not disclosed and in fact, dangerous amounts of emission will be present in this system by virtue of the requirement that a full exhaust must be present during solvent spray and atomization sequence. Accordingly, in addition to the known defects of physical contact systems which degrade the percision in electronic grade etched poly masks used to define integrated circuit conductor patterns, no technique of solvent emission abatement is present.

Non-contact systems of cleaning masks used in screen printing processes are known, as typified by German Pat. No. 1,339,906. In this patent, an off-line mask cleaner is used employing a stationary solvent spray together with an air dry system. The structure is capable of cleaning and drying electronic grade masks saturated with thick film refractory metal paste. The system as described is an analog to screening systems in use in the 1976–1977 timeframe. However, in order to contain toxic vapor emissions to thereby comply with contemporary environmental controls, the spray, dry, and exhaust system of this reference are inapplicable. Moreover, given these emission criteria, the use of stationary solvent spray devices cannot satisfy these criteria when used in combination with prior art air dry systems.

A deficiency of this prior art technique lies in the volume of solvent and air required to effectively clean the screens. Moreover, in the working chamber, moly buildup of residual materials on the chamber walls tends to occur. This buildup, a variable surface area parameter, complicates the adequate definition of system criteria for controlling emission volumes. The moly material tends to build up in a cellular structure creating a sponge-like effect entraining the liquid solvent. Subsequent solvent evaporation during the mask dry operation therefore creates excess amounts of emission by depleting the trapped solvent in this cellular deposit. Hence, emission control capabilities are severely diminished.

Another technique of cleaning masks following screening is defined in German Pat. No. 1,081,480. This reference is premised on the fundamental recognition that mask cleaning is necessary following each screen pass in order to protect the yield of the overall system. A variety of steps are defined, including an air blast to dislodge paste from the pores of the mask. In conjunction with the air blast, a vacuum/suction is applied to collect excess paste. In the performance of these steps, the mask is stationary within the device and the air blast and/or vacuum traverses the mask as an adjunct to the printing squeegee. A roller saturated with solvent is in contact with the mesh mask. A doctor blade may be used to mechanically abrade the paste from the surface of the mask. Another patent showing the use of a doctor blade per se in U.S. Pat. No. 4,282,807.

The cleaning technique is not applicable for use on etched moly masks of the type employed for thick film electronics manufacture. Specifically, the viscosity, density and surface wetability characteristics of the refractory metal paste employed for such thick film metalization of MLC substrates precludes any of the cleaning methods defined in this reference. Rather, the prior art has recognized that in moly masks used for thick film electronics, a high pressure solvent spray is required and secondly, this prior art does not deal with the reduction of solvent emissions from the apparatus, an important environmental consideration.

Within the prior art, a variety of high pressure techniques are also recognized as having application for cleaning various surfaces utilizing perchlor. IBM TDB, Vol. 9, No. 10, Mar. 1967, pp. 1358–1359 shows a nozzle which mixes perchlor and compressed air for washing modules utilizing separate air and liquid intakes and a common washing nozzle. The device finds specific application to clean ceramic substrates but would not be suitable for the removal of a thick film from a moly mask due to insufficient knife action.

The use of air alone to clean via holes in green sheets, that is, unfired ceramic sheets, is shown in IBM TDB, Vol. 22, No. 9, Feb. 1980, pp. 4066–4067. The system utilizes an air knife which, by Bernoulli, maintains the green sheet in close proximity to an output port while cleaning the top surface of any contaminants. Another air blast system in German Pat. No. 952,350 and in IBM TDM Vol. 21, No. 2, July 1978.

A hydraulic cleaning device is shown in IBM TDB, Vol. 24, No. 1A, June 1981, pp. 162–163. The object to be cleaned is placed on a platen 10 and directed into a closed environment for cleaning. A rodless cylinder 28 contains a series of spray heads which move from the top of the chamber to the bottom and then back again in a series of oscillatory cycles. A series of drying knives 72 utilize nitrogen to simply evaporate the cleaning fluid water from the object to be cleaned. At an end of a predetermined time, the object is conveyed out of the chamber on the platen. Thus, while the cleaning spray is oscillatory utilizing water, drying by means of the knives 23 does not provide any stripping action.

Other prior art considered but deemed less relevant comprises U.S. Pat. Nos. 1,687,090; 1,742,249; 1,776,456; 2,704,510; 3,610,141; and 3,956,987. These patents along with Swiss Pat. No. 155,098 and German Pat. No. 915,272 relate generally to screening techniques which have either no recognition of the problem of mask cleaning or use elementary techniques directly at the screening station.

SUMMARY OF THE INVENTION

Given the shortcomings of the prior art, it is an object of this invention to define a system for cleaning material from the surface of an object when used in an in-line system that cleans that surface without damage and without detracting from the overall productivity of the production line.

Yet another object of this invention is to define a system for cleaning masks used in the screening of multilayer ceramic substrates that provides emission level control consistent with environmental criteria for operations having significant human interaction.

Still another object of this invention is to define a system that removes paste from MLC masks yet is self-cleaning within the cleaning chamber. This object of the invention seeks to eliminate the buildup of solids within the cleaning chamber thereby minimizing surface area for subsequent solvent evaporation and/or emission.

An important object of this invention is to define an apparatus to remove solids from screening masks by the mechanical action of the spray system such that the solvent requirements are minimized and the residue is stripped away by subsequent application of an oscillatory air-knife system.

These an other objects of this invention are attained in an apparatus for cleaning a material, typically excess paste, from an object such as an MLC mask. The mask is placed in a vertical orientation between a series of perchlor and air jet nozzles. In a first pass, the perchlor nozzles move downward providing a continuous line of liquid spray to both surfaces of the mask. This descending sweep toward a sump arrangement disposed at the bottom of the chamber tends to focus any excess solvent toward the sump. Following application of the perchlor (in either a single or multiple pass), gas nozzles provide a continuous line of high pressure air acting in an air knife configuration to strip the solvent and paste off the mask by forming a wedge between the surface of the mask and the material being stripped away. The system operates in real time, in-line environment to clean and dry a film mask saturated with excess thick film moly paste within a duty cycle time required for other steps in the screening process. This is done while maintaining environmental standard of 12.5 ppm of perchlor consistent with applicable environmental standards for areas occupied by human operators. These objects and other aspects of the invention will be explained in greater detail by referring to the drawing and the description of the preferred embodiment which follows.

DETAILED DESCRIPTION OF THE PREFERRED EMBODIMENT

Figure 1:
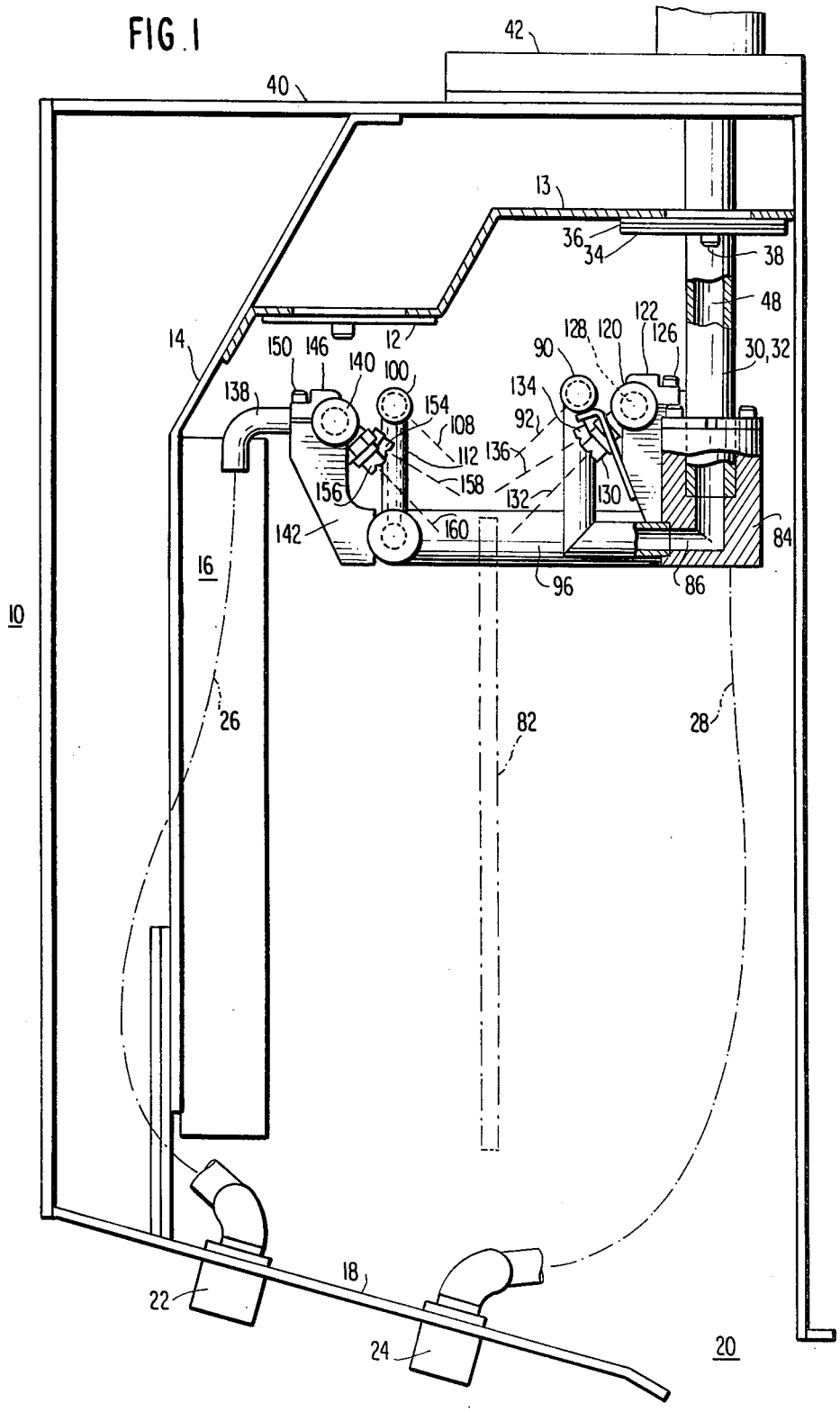
FIG. 1 is a side elevation view, partly in section, showing the cleaning chamber and nozzle system in accordance with this invention.

Referring now to FIG. 1, the present invention utilizes a sealed, airtight chamber 10 having at the upper portion an air duct cover 12 suitably attached to a spray plate assembly 13, 14. A bracket 16 coupled to the spray plate is used to hold a series of mask curtains, not shown. The floor 18 of the chamber 10 is downwardly sloped toward an open solvent drain 20. Hose attachments 22 and 24 are used to supply solvent, typically perchlor, via flexible hoses shown schematically as elements 26, 28 to the reciprocating nozzle assembly.

Figure 3:
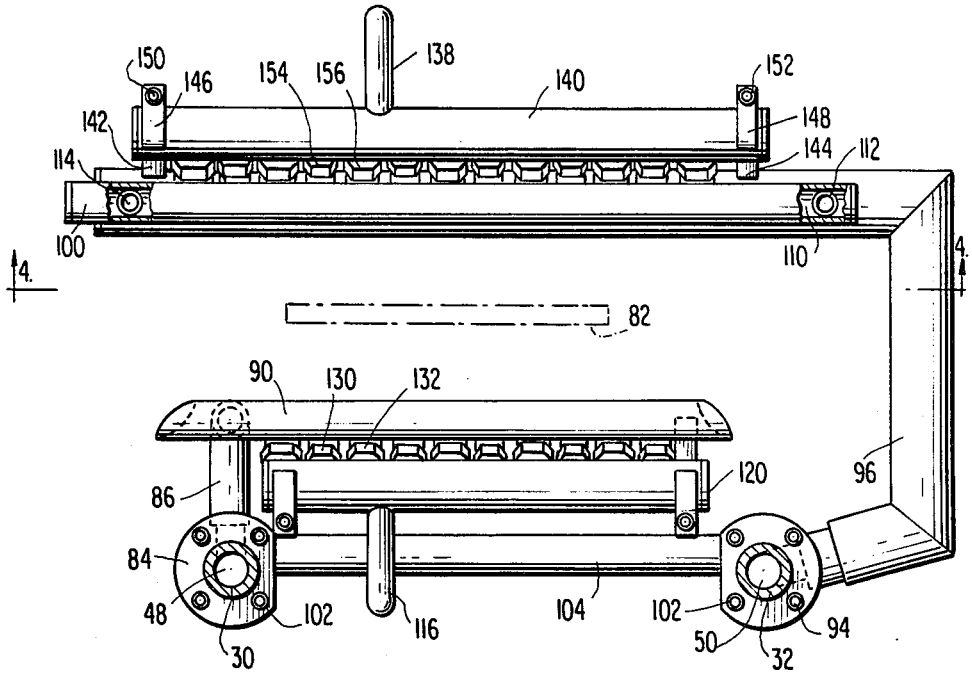
FIG. 3 is a plan view of the nozzle assembly.
Figure 4:
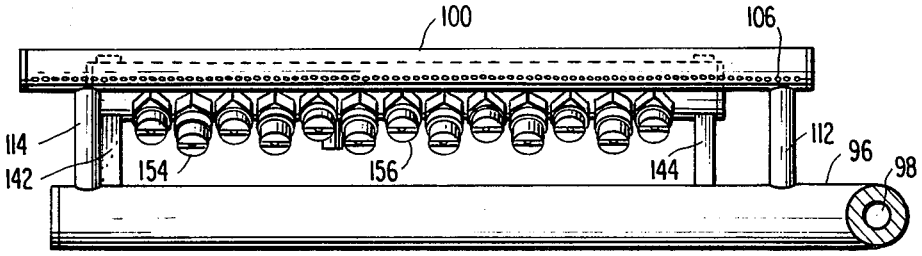
FIG. 4 is a partial section view along line 4—4 of FIG. 3 illustrating the details of one side of the nozzle assembly.

The nozzle assembly, to be described in greater detail relative to FIGS. 3 and 4, is mounted on hollow shafts 30, 32 which pass through the air duct cover 12 in a sealed relationship as a function of wiper 34 retained by a wiper retainer 36 on the air duct cover 12. A suitable mounting 38, such as a bolt assembly or the like, couples the wiper 34 and wiper retainer 36 to the top cover plate 13. While a single wiper 31 is shown relative to shaft 30, it is understood that a second identical wiper and retainer assembly is disposed relative to shaft 32. The wipers function to effectively constrain any residual solvent and paste within the cleaning chamber. Thus, as the shafts 30, 32 reciprocate any solvent or solids removed from a mask to be cleaned are restrained within the chamber.

Figure 2:
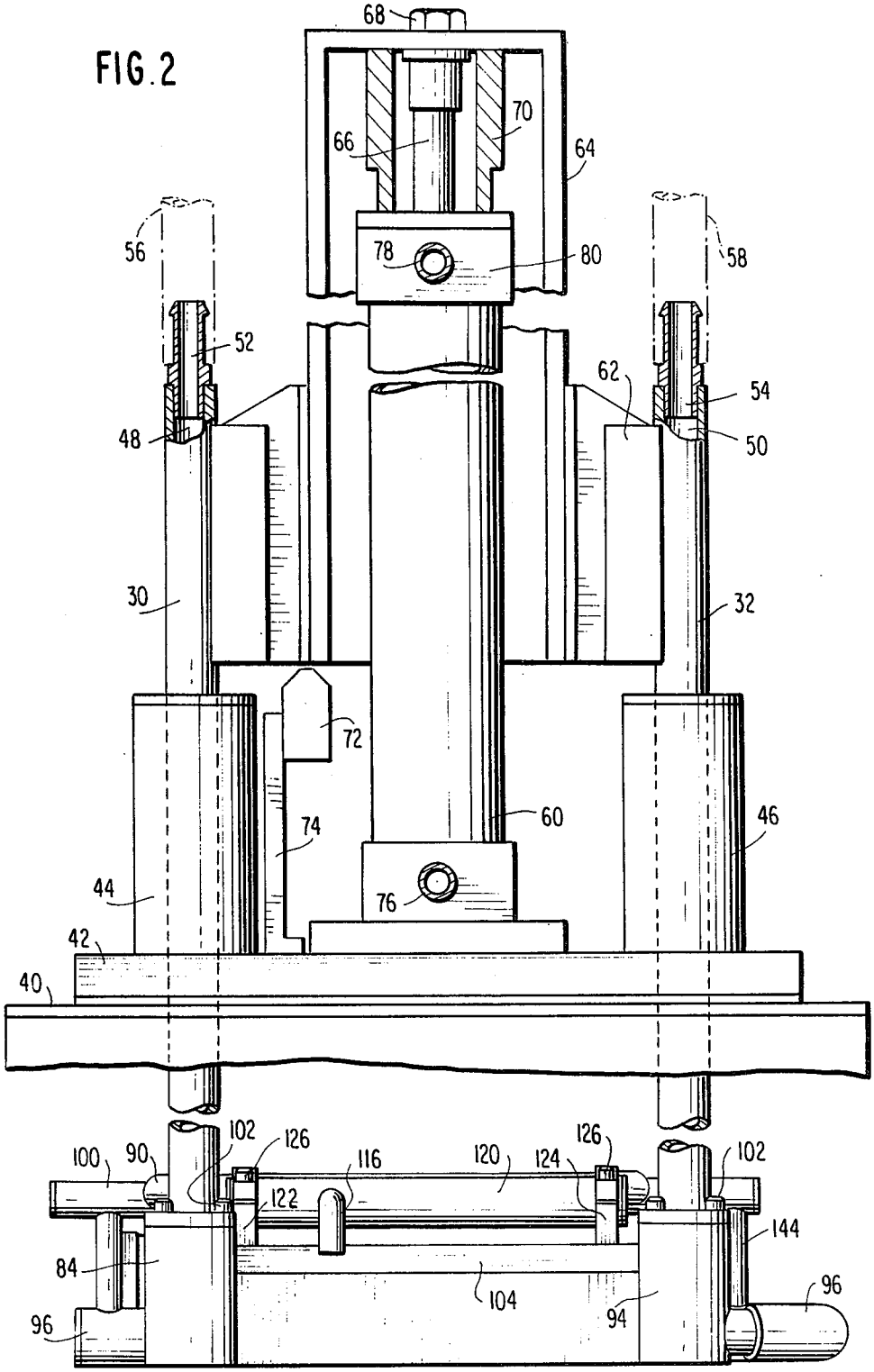
FIG. 2 is a front elevation view showing the drive mechanism for the nozzle assembly.

Referring more specifically to FIG. 2, the details of the spray head reciprocation system are shown. On the top cover 40 of the cleaning chamber 10, a pedestal 42 is disposed to mount a pair of shaft sleeves 44 and 46. The sleeves 44 and 46 contain internally suitable bushings and bearings (not shown) to align the shafts 30 and 32 for parallel reciprocating movement. Also, not shown, are grease fittings, spacers, and the like which will be appreciated by one of working technology to be ancillary to the functioning of the shaft sleeves.

As shown in FIG. 2, each of the shafts 30 and 32 are hollow having axial internal bores 48 and 50. At the top of each hollow shaft, an adaptor tube 52, 54 is placed having an outer diameter slightly greater than the inner wall diameter of the shaft so that frictional engagement is obtained. As shown, attached to the top end of each adaptor are conduits 56, 58 for the purpose of providing cleaning gas into the air-knife assembly. Each adaptor tube has an outwardly projecting flange to define the limit of insertion into the respective shaft and additionally fix the conduits 56, 58 onto the adaptor. The top end of the adaptor has an outwardly extending rim portion to fix the respective conduit to an adaptor. Although not shown, each adaptor may also have at the opposite end thereof a second outwardly extending flange to fix the adaptor to the internal wall of the shaft.

The conduits 56, 58 are flexible so that as the shaft reciprocates, a supply of pressurized gas is introduced, uninterrupted by kinks, and the like. Accordingly, the shafts 30 and 32 in addition to providing the means by which the cleaning nozzles oscillate also function to deliver pressurized gas to the air-knife assembly. The shafts themself are driven by means of an air cylinder 60 which is coupled to the respective shafts by means of a shaft support 62 coupled to a drive bracket 64. The drive bracket 64 is in turn operatively coupled to piston rod 66 by means of a lock nut 68 or other suitable fastener. A cylinder stop is operatively coupled to the top inside wall of the drive bracket 64. This stop defines the positive lower limit of travel of the piston rod 70 and therefore also the travel limit of the bracket 64 relative to the air cylinder 60. The lowermost limit of travel may be determined by the use of a microswitch 72 which is coupled to the pedestal 42 by means of a suitable bracket 74. Thus, the microswitch produces an electrical output to the system determining when the drive bracket has reached its lowermost postion. Any other limit position sensor may be used in place of the microswitch 72.

The air cylinder may be a "Tom Thumb Model No. EL-MF 2". This unit, commercially available, need not be discussed in greater detail, it being appreciated that two pressure hoses 76, 78 are employed to provide fluid pressure into the cylinder for purposes of selectively driving the internal piston, not shown, up or down by varying the pressure on either side of the piston as a function of fluid input to the cylinder. The air cylinder 60 has a top housing 80 containing a reed switch, not shown, which senses the uppermost limit of travel of the piston. Thus, by providing a second electrical signal to the system in conjunction with the microswitch 72, top and bottom limits of piston travel can be ascertained. It will be appreciated that a number of different techniques can be employed to effectuate reciprocating action of the nozzle assembly. Also, other techniques of sensing the top position other than by internal reed switch can be used.

Referring now to FIGS. 1, 2, and 3, the details of the cleaning nozzle, air-knife assembly will be delineated. The assembly basically comprises pairs of parallel liquid spray nozzles and air-knife jets. The nozzles are aligned in manifolds (headers) with the pairs of headers disposed on respective sides of a mask to be cleaned. The mask is schematically shown as element 82 disposed in a vertical orientation, vis-a-vis the spray assembly. The technique of handling and supporting the mask need not be delineated in detail since a variety of suitable techniques may be employed. As the spray assembly reciprocates, first a liquid spray and then an air spray is downwardly directed onto both sides of the mask. While the assembly reciprocates, cleaning action by the perchlor liquid is initiated and maintained only during the downward segment of reciprocating motion. Similarly, the stripping action of the air knife is performed during a subsequent pass during the top to bottom portion of reciprocating motion of the assembly. During the return portion of the cycle, neither solvent nor air is released.

The air knife portion is defined by input conduits 48 and 50 within the shaft 30 and 32. As shown in FIG. 1, the conduits terminate in an air-knife adaptor assembly. A first adaptor 84 has an internal conduit 86 to provide gas under pressure from the bore 48 to a manifold 90. A series of air holes, not shown, in the manifold 60 direct an outward high pressure stream of air at an angle, 60° as shown by the dotted line 92. Typically, the pressure at the air knife defined by the manifold outlet ports is in the order of 30 psia. The importance of the 60° orientation of the air spray 92 will be explained in greater detail herein.

A second adaptor 94 receives gas under pressure from conduit 50 and delivers it through connecting pipe 96 having an internal axial bore 98 to a second air knife 100. The adaptors 84 and 96 are coupled to their respective shafts by means of locking rings held in position by means of bolts and locking nuts 102. Thus, as the shafts 30 and 32 reciprocate, the adaptors 84 and 86 move with the shaft thereby carrying with it the air-knife assembly. The adaptors 84 and 94 are locked together by means of a coupling bar 104 to define a rigid coupling between the adaptors.

Air knife 100 opposes air knife 90 and by means of holes 106 projects downwardly a gas spray 108 at an angle of approximately 60°. Thus, the opposing air sprays 92 and 108 provide stripping action to both sides of the mask 82 simmutaneously.

Air knife 100 has an internal manifold 110 receiving a gas, typically air under pressure from conduit 96 via spacer elements 112 and 114. Spacer elements 112 and 114 have internal bores to establish fluid communication between the conduit 96 and the manifold 110. Thus, air under pressure, typically 30 psia from the shaft 32 is delivered via conduit 96, the bore in spacer 112, 114 through manifold 110 for release through holes 106. Those holes may be typically 0.047 inches in diameter and as shown in FIG. 4, extend in a line across the manifold 100 to effectively cover the lateral dimension of the mask 82.

The liquid cleaning spray nozzles deliver a cleaning solvent typically, perchlor to the mask and are disposed in an opposed relationship shown best in FIG. 1. The spray nozzle assemblies receive solvent throgh inlet conduits 22 and 24 via hose assemblies 26 and 28. Thus, as the spray system reciprocates, the hoses 26 and 27 have sufficient free length to follow the movement without kinking or bending thereby delivering solvent at a constant pressure, typically 40 psia. The assembly associated with air knife 190 has an inlet pipe 116 coupled to a manifold 120. The manifold is fixed to the brace bar 104 by means of a pair of flange hold-down assemblies 122 and 124 and associated bolts and cap nuts 126, 128. Thus, the manifold 120 is accurately fixed from the bar 104 in a spaced relationship from air knife 90. Manifold 120 has an internal chamber 128 delivering solvent to the nozzle assembly. The assembly directs the nozzles at different angles at alternative positions as shown in FIG. 1. That is, the nozzles alternate, with one nozzle 130 having a fluid spray direction 132, 30° to the vertical while a second nozzle 134 has a direction of fluid spray 136, 45° to the vertical. The nozzles 130, 134 are screwed into the header 120, the header being previously bored and tapped to define holes at the proper alternating angular relationship for the nozzles.

A second parallel spray nozzle assembly has an input pipe 138 to a spray nozzle header 140. The header 140 is a cylinder spaced from conduit bar 96 by means of a bracket 142, 144. The header is locked in place on the respective bracket bars by means of a clamp 146, 148 held down by a bolt and nut assembly 150, 152.

The header 140 has a series of tapped bores defining exit holes into which nozzles 154 and 156 are screwed. As shown in FIG. 4, the nozzles 154 and 156 alternate in their position such that nozzle 154 releases a solvent spray 158 at an angle of 45° to the vertical while nozzle 156 releases a nozzle spray 160 at an angle of 30° to the vertical. FIG. 4 shows the alternate arrangement of the nozzles 154 and 156. While the nozzles as shown extend across each header, it is understood that any number could be used so long as adequate spray coverage relative to the mask is obtained.

In operation, the system forms one portion of an automatic multilayer ceramic screening system. Such a system is shown in copending application Ser. No. 193,724. In accordance with that application, as masks are used at various screening stations and the screening paste forms a residue requiring mask cleaning. The present invention is used at the station defined in the copending application as the automatic mask cleaner unit (110) which is integrated with the screening station console. Thus, cleaning chamber 10 as described herein functionally represents the cleaner unit in the copending application.

Masks having a residue of paste are moved in a vertical manner inside housing 10 and the compartment is then sealed. The air knife and spray bar assembly mounted on shafts 30 and 32 is disposed in its uppermost position. In a first downward sweep, the spray nozzle assemblies comprising sets of nozzles 130, 134, 154, and 156 deliver perchlor simultaneously to both sides of the mask. The fluid pressure of the spray nozzles is in the order of 40 psia. The perchlor acts in a known manner on the excess paste tending to free it from the mask surface. The sprays 132 and 160 are disposed at a 30° angle while sprays 136 and 158 are at a 45° angle relative to the vertical surfaces of the mask 82. This angular relationship forms a wedge relative to the mask surfaces in the direction of the downward sweep tending to dislodge the paste from the mask. By using liquid sprays at two different angles, the wedge effect of the liquid spray relative to the mask is accenuated.

When the air knife and spray arm assembly reaches its lowest-most position as sensed either by the microswitch 72 or the stop member 70, the perchlor spray is discontinued. The arm then returns to a top position for either a second application of perchlor or stripping by means of the air knife spray. That is, depending on the type of mask and paste material, one or more application of perchlor may be required before removal by the air knife. The air knife assembly also acts in a downward sweep with the spray direction through air knife ports at a 30° angle relative to the surfaces of the mask. During this downward sweep, a wedge effect is created between the mask surface and the excess paste to strip away in a continuous manner the perchlor and paste from the mask. The material is drained away via drain opening 20. Once the mask is cleaned, an air-tight access cover is then opened and the mask is removed for use in the screening process.

An important aspect of this invention is that it provides positive vapor emission control to maintain emission levels in conformance with Federal Regulations, that is, less than 12.5 ppm of perchloroethylene within the operating environment. Positive control is maintained within the chamber 10 in the form of air baffles and exhaust shutters to ensure that all the emissions are removed utilizing a constant velocity exhaust damper to eliminate emission fluctuation. This is accomplished by gating exhaust vapors from both sides of the mask through respective outlets having shutter assemblies. Hence, once cleaning has taken place, but before the mask is removed, the shutters are opened to gate all exhaust vapors from the chamber. Safety is accomplished by utilizing a double shutter device which in conjunction with a variable orifice maintains a constant air flow.

The device in accordance with the present invention is also advantageous in that it is self-cleaning. That is, as shown in FIG. 1, the orientation of the spray system is such that it inhibits the formation of solid buildup on the inner surfaces of the chamber 10. The solids which tend to build up are swept away by the perchlor and air knife sprays. The absence of a solid buildup maintains the minimum surface area for potential subsequent solvent evaporation/emission. Thus, those levels are continuously minimized by the inherent action of the system. The absence of such a solid buildup also minimizes down time required for maintenance, periodic cleaning, propensity for mechanical failures and the like. Thus, the system operates within the strict operating confines of an overall screening system that cleans masks and returns them for operation within duty cycle times imposed by that system.

Finally, the apparatus minimizes the amount of virgin perchlor which is necessary to perform the cleaning operation. This is achieved by the orientation of the nozzles and their continued proximity during the sweep of the mask surfaces. Hence, overall costs are minimized together with minimization of overall emission potential which is a function of perchlor use and entrapment.

While the system has been defined with respect to the preferred embodiment thereof, it will be appreciated by those skilled in this technology that various modifications may be practiced without departing from the overall scope of the invention.

We claim:

1. Apparatus for cleaning material from a surface of an object, comprising;

a cleaning chamber;

movable support member means within said chamber having extended along its length a line of liquid dispensing nozzles and a line of gas dispensing ports for respectively cleaning and drying said surface, said liquid dispensing nozzles and said gas dispensing ports arranged to respectively provide a continuous line of liquid spray and a continuous line of gas angled with respect to said surface so as to form a wedge therewith in the direction of motion of said movable support member means;

means for vertically moving said support member with respect to said surface; and said means for vertically moving said respective lines of ports and nozzles oriented with respect to said object so that said liquid dispensing nozzles act to provide said continuous line of liquid spray to remove said material from said surface when said line of spray is moved vertically across said surface and said gas dispensing ports subsequently act to provide said continuous line of gas to remove said liquid from said surface when said line of gas is moved vertically across said surface, whereby said material and liquid deposit in said chamber below said surface for collection and removal.

2. The apparatus of claim 1 further comprising a second line of liquid dispensing nozzles and a second line of gas dispensing ports positioned on said movable support member means in an opposed relationship relative to said line of liquid dispensing nozzles and said line of gas dispensing ports for cleaning a second surface of said object.

3. The apparatus of claim 1 wherein said liquid dispensing nozzles are oriented at two different angles with respect to the surface to be cleaned.

4. The apparatus of claim 3 wherein said liquid dispensing nozzles differ in angular orientation along said line.

5. The apparatus of claim 3 wherein the angular orientation of said gas dispensing ports relative to said surface is constant.

6. The apparatus of claim 2 wherein said movable support member means comprises a first conduit to supply gas to said line of gas dispensing ports and a second conduit supporting said second line of gas dispensing ports and supplying gas thereto.

7. The apparatus of claim 6 wherein said second conduit further comprises bracket means to support said second line of liquid dispensing nozzles in a spaced position from said second line of gas dispensing ports.

8. The apparatus of claim 1 wherein said movable support member means comprises conduit means to supply gas to said line of gas dispensing ports.

9. The apparatus of claim 1 wherein said means for vertically moving said support member comprises movable shaft means coupled to said movable support member, a drive piston and cylinder assembly mounted on a base and, means to couple said shaft means to said piston.

10. The apparatus of claim 9 wherein said movable shaft means comprise a hollow shaft to supply pressurized gas from a source thereof outside said chamber and, means to transfer gas from said hollow shaft to said line of gas dispensing ports.

11. The apparatus of claim 10 wherein said means to supply gas from said hollow shafts comprises a first conduit disposed in said movable support member means to fluidly couple said line of gas dispensing jets to said hollow shaft.

12. The apparatus of claim 10 wherein said shaft means comprises a second parallel hollow shaft, means to supply gas to each of said hollow shafts, a second line of gas dispensing ports positioned on said movable support member means in an opposed relationship to said line of gas dispensing ports and, conduit means for delivering gas under pressure from said second hollow shaft to said second line of gas dispensing nozzles.

13. The apparatus of claim 1 wherein said gas dispensing ports are aligned positioned longitudinally across said surface of said object to define an air knife for drying said surface without the necessity of drying said entire cleaning chamber.

* * * * *